US005722445A

United States Patent [19]

Hae et al.

[11] Patent Number: 5,722,445

[45] Date of Patent: Mar. 3, 1998

[54] MULTIPURPOSE CANE

[76] Inventors: Shyu Shing Hae, 9F, No. 15, Lane 51, Min Chuan St., Jwu Nan, Miaoli; William Du, No. 57-7, Alley 90, Sanguang Lane, Lin 22, Peishing Li, Peitun District, Taichung, both of Taiwan

[21] Appl. No.: 829,872

[22] Filed: Apr. 2, 1997

[51] Int. Cl.[6] ..... A45B 3/00

[52] U.S. Cl. ..... 135/65; 135/910; 362/102

[58] Field of Search ..... 135/910, 911, 135/16, 65, 66; 362/102, 32

[56] References Cited

U.S. PATENT DOCUMENTS

| | | | |
|---|---|---|---|
| 1,051,370 | 1/1913 | Hertz | 135/910 X |
| 1,079,088 | 11/1913 | Wysocki | 135/910 X |
| 1,427,138 | 8/1922 | Walicki et al. . | |
| 1,509,157 | 9/1924 | Leano . | |
| 1,595,023 | 8/1926 | Probe . | |
| 1,723,780 | 8/1929 | Hayhoe . | |
| 2,478,325 | 8/1949 | Russell . | |
| 2,597,172 | 5/1952 | Parker . | |
| 3,336,469 | 8/1967 | Barnes, Sr. et al. . | |
| 4,625,742 | 12/1986 | Phillips . | |
| 5,582,196 | 12/1996 | Hae et al. . | |

*Primary Examiner*—Lanna Mai

*Attorney, Agent, or Firm*—Morton J. Rosenberg; David I. Klein; Jun Y. Lee

[57] ABSTRACT

An improved multi-purposed cane including a handle and a stick attached to the root portion of the handle. The handle is integrally configured defining a receiving chamber extending horizontally and longitudinally. In the left half portion of the receiving chamber, an electrical components set is attached and retained thereof. The electrical components set includes a battery cell, a printed circuit board, a lamp, a push button switch, and a warning light disposed at the rear portion of the receiving chamber. The improved features is the bottom portion of the battery cell which is provided with a recess corresponding to the root portion of the handle. The root portion of the handle defines vertically an inner chamber having a clipping element thereof. The clipping element includes a biasing post, a compression spring and a cap button. The cap button is received in the recess and its top is projected into the receiving chamber. By this arrangement, the electrical components set can be readily and removably snapped into the handle via this mechanical engagement. Furthermore, a high level alarming device can be integrally connected to the electrical components set to scarce off the invader.

4 Claims, 2 Drawing Sheets

MULTIPURPOSE CANE

FIELD OF THE INVENTION

The present invention relates to an improved multipurpose cane, more particularly, to an improvement of a multipurpose cane described on the U.S. Pat. No. 5,582,196, hereinafter referred to as '196, issued and owned by the same applicant.

In said '196 patent, a multipurpose having functions of lighting, warning and storing is provided. A lamp and a switch are disposed in the front tip of the handle for providing light spotted ahead for walking and a warning LED is disposed at the tail portion of the handle. The handle defines a battery case for receiving batteries therein in the front half and a storage chamber in the rear half. Basically, the handle is integrally formed to provide a rigid configuration. The electrical components disclosed in said '196 patent, including lamp, switch, warning lamp, printed circuit board, battery and case are also integrally assembled. These components set is fixedly attached to the handle by means of a permanent magnet. By this arrangement, the electrical components set can be readily removed from the handle for replacement of an exhausted batteries or reduce the weight of the handle for daylight walking.

Even the '196 patent can really achieve to its predetermined objective, the inventor is still not satisfactory to this level. An effort is still given to increase the utility of the cane and reduce the manufacturing cost. Accordingly, an improvement is provided and is aimed to the engagement between the electrical components set and the handle and the configuration of the storage chamber. Wherein the engagement between the electrical components set and the handle attained by the permanent magnet disposed at rear end of the electrical components and the magnet disposed at the inner partitioning wall of the handle is replaced by a mechanic engagement which includes a clipping element disposed at the lower portion of the electrical components and a fastener disposed at the root portion of the handle. The mechanic engagement attained by the clipping element and the fastener is more practical and cost-effective during the manufacturing process. On the other hand, the storage chamber disposed after the battery case can be replaced with a alarming device. When the electrical components set is removed, the alarming device is removed altogether.

DETAILED DESCRIPTION OF PREFERRED EMBODIMENT

Figure 1:
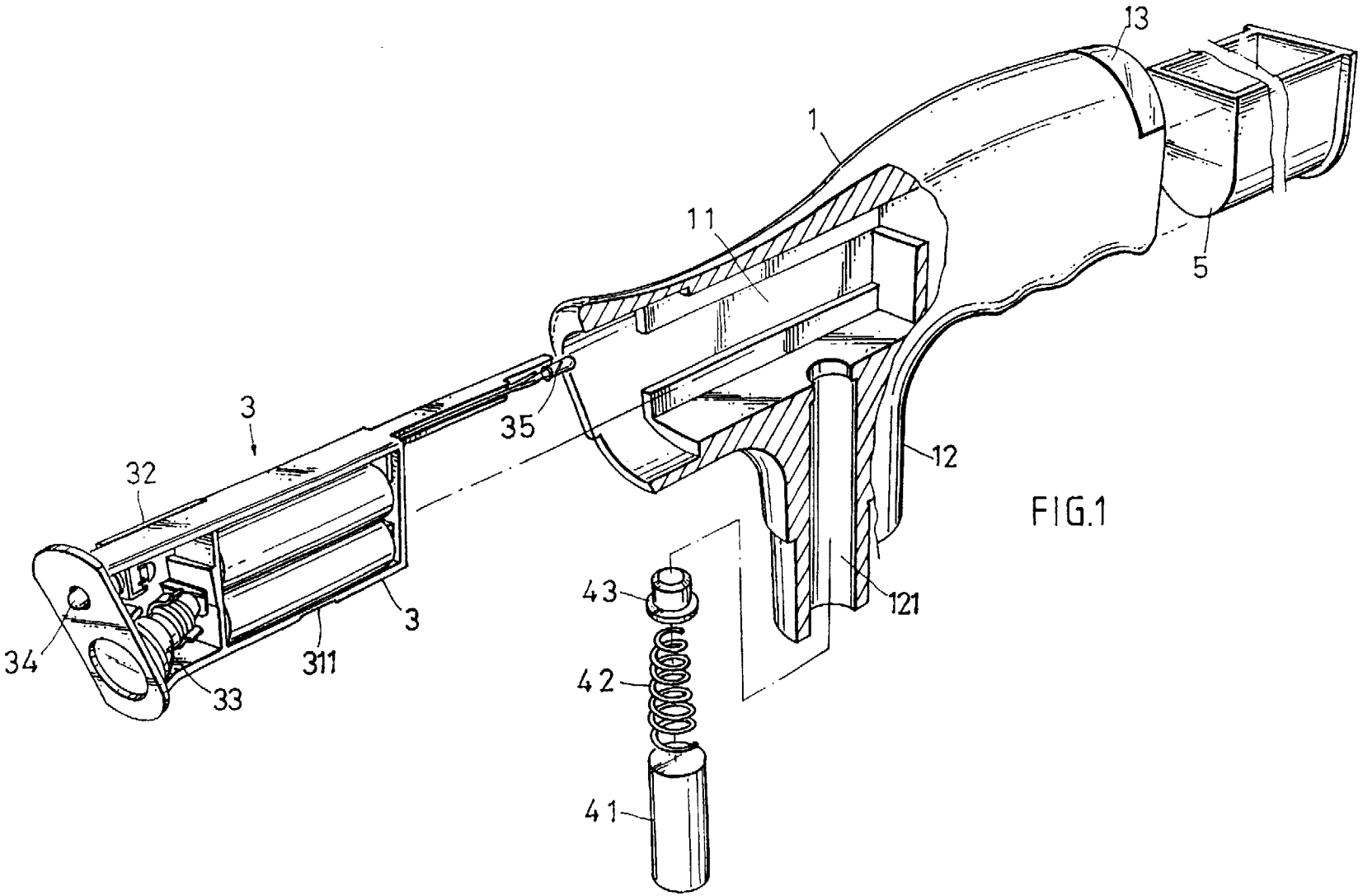
FIG. 1 is an exploded perspective view of the improved multipurpose cane made according to the present invention.
Figure 2:
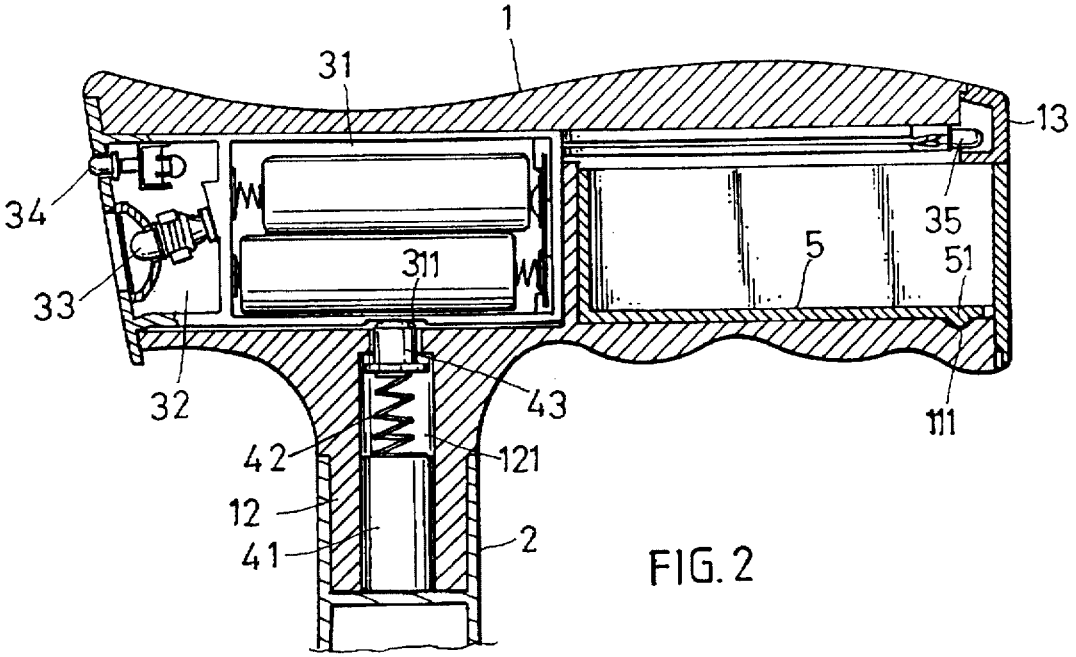
FIG. 2 is a cross sectional view of the improved multipurpose cane made according to the present invention.

Referring to FIGS. 1 and 2, the improved multipurpose cane made according to the present invention generally comprises a handle 1 and a stick 2 attached to the root portion 12 of the handle 1. The handle 1 is integrally configured defining a receiving chamber 11 extending horizontally and longitudinally. The left half portion of the receiving space 11, as viewed from FIG. 1, an electrical components sets 3 is attached and retained thereof. The electrical components set 3 includes a battery cell 31, a printed circuit board 32 (which is disposed at side and is not shown for clarity, only a sketch is given), a lamp 33, a push button switch 34, and a warning light 35 disposed at the tail portion of the receiving space 11 and which is preferably a LED. Those components are identical to the components disclosed in the aforesaid '196 patent. The improved features of the present invention is the bottom portion of the battery cell 31 is provided with a recess 311 corresponding to the root portion 12 of the handle 1. The root portion 12 of the handle 1 defines vertically an inner chamber 121 having a clipping element thereof. The clipping element includes a biasing post 41, a compression spring 42 and a cap button 43. The top of the cap button 43 is projected into the receiving chamber 11 and is received into the recess 311. By this arrangement, the electrical components set 3 can be readily snapped into the handle 1 via this mechanical engagement. In practice, the top of the cap button 43 has a dome or a spherical configuration. Accordingly, the electrical components set 3 can be readily removed from the handle 1 for replacement of a battery, for example.

The right half of the receiving space 11 is received with a drawer 5 for storing first aid or key. The drawer 5 is different to the storage chamber disclosed in '196. As a matter of fact, the drawer 5 provided by this prevent invention is more convenient than the '196. The bottom of the drawer 5 is provided with a resilient hooker 51 for engaging with the recess 111 of the receiving chamber 11. The right side surface of the drawer 5 is provided with a light shade 13 to cover the warning light 35. The light shade 13 and the right side wall of the drawer 5 jointly define the right end surface of the handle 1.

Figure 3:
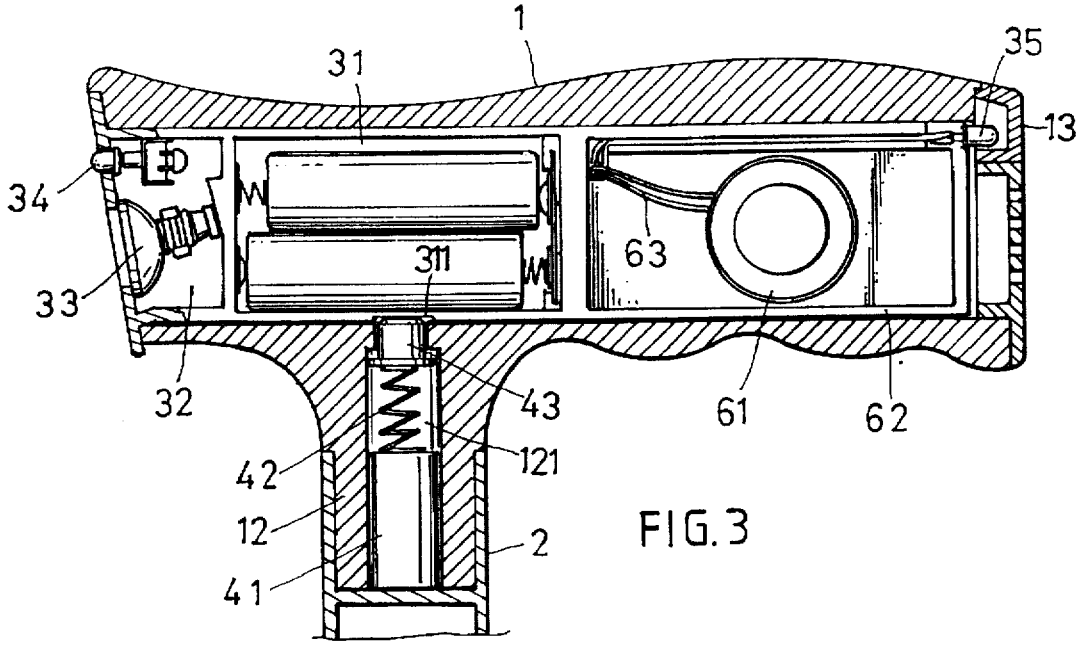
FIG. 3 is a cross sectional view of another embodiment of the improved multipurpose cane made according to the present invention.

Referring to FIG. 3, a cross sectional view of another embodiment is shown. In order to provide a defending effect to the present invention, the right half of the receiving chamber 11 is provided with a high level alarming device 61 which is disposed after the electrical components set 3. In case of emergency, the alarming device 61 can be triggered to give a warning sound and scare the invader. The alarming device 61 is integrally connected with the above described electrical components set 3 via housing 62 and lines 63. By this arrangement, when the electrical components set 3 is removed from the handle 1, the alarming device 61 is also removed.

While particular embodiments of the present invention have been illustrated and described, it would be obvious to those skilled in the art that various other changes and modifications can be made without departing from the spirit and scope of the invention. It is therefore intended to cover in the appended claim all such changes and modifications that are within the scope of the present invention.

We claim:

1. An improved multipurpose cane comprising a handle and a stick attached to the root portion of said handle, said handle being integrally configured defining a receiving chamber extending horizontally and longitudinally therein, the left half portion of said receiving space being provided with an electrical components sets, said electrical components set including a battery cell, a printed circuit board, a lamp, a push button switch, and a warning light disposed at the tail portion of said receiving space;

the bottom portion of said battery cell being provided with a recess corresponding to said root portion of said handle, said root portion of said handle defining vertically an inner chamber having a clipping element thereof, said clipping element including a biasing post, a compression spring and a cap button, the top of said cap button being projected into said receiving chamber and being received into said recess, wherein by this arrangement, said electrical components set can be readily and removably snapped into the handle via this mechanical engagement.

2. An improved multipurpose cane as recited in claim 1, wherein the top of said cap button is a dome or spherical configuration.

3. An improved multipurpose can as recited in claim 1, wherein the right half of said receiving chamber is provided with a drawer for receiving first aid or keys.

4. An improved multipurpose drawer as recited in claim 1, wherein the right half of said receiving chamber being provided with a high level alarming device which is integrally connected to said electronic components set via a housing and lines.

* * * * *